US006311582B1

(12) United States Patent
Chow

(10) Patent No.: US 6,311,582 B1
(45) Date of Patent: Nov. 6, 2001

(54) DEADBLOW CLAW HAMMER

(76) Inventor: Howard Chow, 72 Greenwood #21, Pasadena, CA (US) 91107

( * ) Notice: Subject to any disclaimer, the term of this patent is extended or adjusted under 35 U.S.C. 154(b) by 0 days.

(21) Appl. No.: 09/696,590

(22) Filed: Oct. 26, 2000

(51) Int. Cl.[7] ..... B25D 1/00
(52) U.S. Cl. ..... 81/22; 81/20
(58) Field of Search ..... 81/22, 20; 254/26 R, 254/26 E

(56) References Cited

U.S. PATENT DOCUMENTS 3,130,762 * 4/1964 Kerr ..... 81/25
3,343,576 * 9/1967 Norcross ..... 81/25
4,039,012 * 8/1977 Cook ..... 81/25
4,831,901 * 5/1989 Kinne ..... 81/20
5,320,001 * 6/1994 Floyd ..... 81/20
5,916,338 * 6/1999 Bergkvist et al. ..... 81/22
5,960,677 * 10/1999 Carmien ..... 81/22
6,128,977 * 10/2000 Gierer et al. ..... 81/22

* cited by examiner

*Primary Examiner*—James G. Smith
*Assistant Examiner*—Hadi Shakeri
(74) *Attorney, Agent, or Firm*—Frank A. Lukasik

(57) ABSTRACT

A shock absorbing claw hammer consisting of a head with a striking face and a claw portion and having a chamber extending through the head. In a first embodiment, an inset step is formed at one end of the chamber to receive a cover plate and an aperture is formed at the opposite end to receive a handle. and The handle is affixed to the head with an epoxy base. The aperture is incompletely filled with shot and a cover plate is affixed to the head. The entire head assembly is cleaned and finished to produce a smooth finish. In a second embodiment, a hole is formed at the top of the chamber, which is sealed and finished after the shot is loaded in the chamber.

3 Claims, 3 Drawing Sheets

DEADBLOW CLAW HAMMER

BACKGROUND OF THE INVENTION

1. Field of the Invention

This invention relates to carpenters' claw hammers for driving and removing nails and striking various objects, and in particular, shock absorbing or dead blow hammers that reduce the recoil and vibration caused by the hammer strike. More particularly, the present invention relates to a shock absorbing hammer including a claw feature and a natural hickory wood, fiberglass, steel or other material handle.

When a percussive tool such as a hammer strikes the surface of an object, part of the energy produced by the strike is used to perform desired work, (e.g. drive a nail) part is converted into heat, and part is dissipated through the hammer. The energy dissipated through the handle often produces undesirable results such as recoil of the hammer from the object being struck or excessive vibration. These undesirable effects have been a persistent problem for the makers of hammers and other percussive tools. Many users of hammers prefer the vibration-reducing feel of wood handled hammers over those with solid steel or fiberglass handles. Hickory wood handles are often the preferred choice of professionals because of the natural feel of the wood and a common perception is that fatigue is reduced at the end of the day when using such.

Past attempts to reduce undesirable results from using hammers include designs which incorporate dampers of shock absorbers of various kinds to produce what is referred to as "dead blow" hammers. One of the earliest attempts to produce such a hammer is reflected in U.S. Pat. No. 1,045,145 issued in November 1912 to E. O. Hubbard. Hubbard explains that the head of a "dead blow" hammer struck against a surface will be forced against a cushion, such that the cushion absorbs a portion of the shock impact caused by the strike.

Several early approaches for reducing recoil in hammers are summarized in U.S. Pat. No. 2,604,914 to Kahlen issued in July 1952. In particular, Kahlen indicates that by 1952, known methods for reducing recoil included placing either a slug, a charge of round shot, or a charge of powdered material in a chamber immediately behind a striking face of the hammer, such that an object(s) placed behind the striking head will absorb some of the forces produced by the hammer strike. The particular approach disclosed in Kahlen involved the placement of a charge of irregularly shaped hard heavy particles in a chamber immediately behind the striking head of a hammer. In addition to solutions involving cushions and charge loads, several solutions utilizing resilient members, such as elastic inserts and springs, were proposed to address the hammer strike problems, whereby a portion of the energy developed from the hammer strike is dissipated through the resilient member. Other designs such as that disclosed in U.S. Pat. No. 5,408,902 use a "lagging mass", which is positioned to move towards the striking portion of the hammer head upon impact, thus impacting the striking portion to reduce hammer recoil. Previous shot filled hammers have been limited: (i) because the requirement for a hollow chamber renders the size of such hammers out of proportion to their weight; and (ii) because, unless a special shot mixture is utilized, the shot is often not useful in preventing hammer recoil. Moreover, in prior art "dead blow" hammers, the prying and nail pulling capability of common claw hammers has been forfeited in the attempts to reduce vibration and recoil.

Further discussion of the prior art and its associated shortcomings us provided in U.S. Pat. No. 1,045,145; in U.S. Pat. No. 2,604,914; in U.S. Pat. No. 2,928,444: in U.S. Pat. No. 4,831,901; in U.S. Pat. No. 5,118,117; in U.S. Pat. No. 5,408,902; and German Patent No, 1,273,449.

Thus a need exists for a shock absorbing hammer which includes a claw feature for pulling nails and prying, and which addresses other problems associated with prior art shock absorbing or dead blow hammers.

SUMMARY OF THE INVENTION

In one aspect of the invention, a shock-absorbing claw hammer includes a natural hickory wood, fiberglass, steel or other material handle and a head which has a striking head portion with a lower surface, a claw portion extending generally opposite the striking head portion. The handle extends generally perpendicular to the sting head portion and the claw portion. The head defines an opening therein and the opening extends completely through at an angle perpendicular to the axis of both the striking head portion and the claw portion. The opening is rectangular in shape and stepped down from a larger chamber to a smaller one into which the tang of the handle can be offered up. The larger chamber has inset steps forming stops onto which a cover plate can be slideably fitted. The remainder of the larger chamber is open to receive steel, lead, titanium or other metal shot weight which is thereafter sealed inside the chamber by the cover plate being fitted and welded in place.

In another aspect of the invention in its assembled form, the hammer's hickory (or other suitable wood or material) handle is offered up into the rear opening of the head and affixed there using epoxy. The epoxy serves the multiple purposes of: (i) affixing the head to the handle; (ii) forming a "floor" in the cavity of the head; (iii) acting as a shock absorber for the metal shot which are loaded and sealed within the head cavity. A steel cover plate is inserted into the stepped opening into the head and welded in place to contain the metal shot. The entire head is thereafter cleaned and finished to produce a smooth esthetic appearance.

The drawings attached hereto will illustrate to those skilled in the art that the present invention is an improvement on the prior art dead blow hammers by reason of the addition of a claw, which is a vital feature in the construction trade, the use of a large shot-filled ballast cavity axially aligned with the striking face and the claw, and the welded cover plate, which when finished by grinding and polishing, becomes an integral part of the hammer head. Additionally, the use of an epoxy adhesive to affix the handle and to act as a shock absorbing medium for the inertial forces within the metal shot and the head itself, is an economical and practical way to combine the discrete components of the hammer in a unique way, permitting the use of old traditional materials (hickory or other woods) and modern computer designed metal castings.

BRIEF DESCRIPTION OF THE DRAWINGS

An example of this invention is illustrated in the accompanying drawings in which.

DETAILED DESCRIPTION OF A PREFERRED EMBODIMENT

Figure 1:
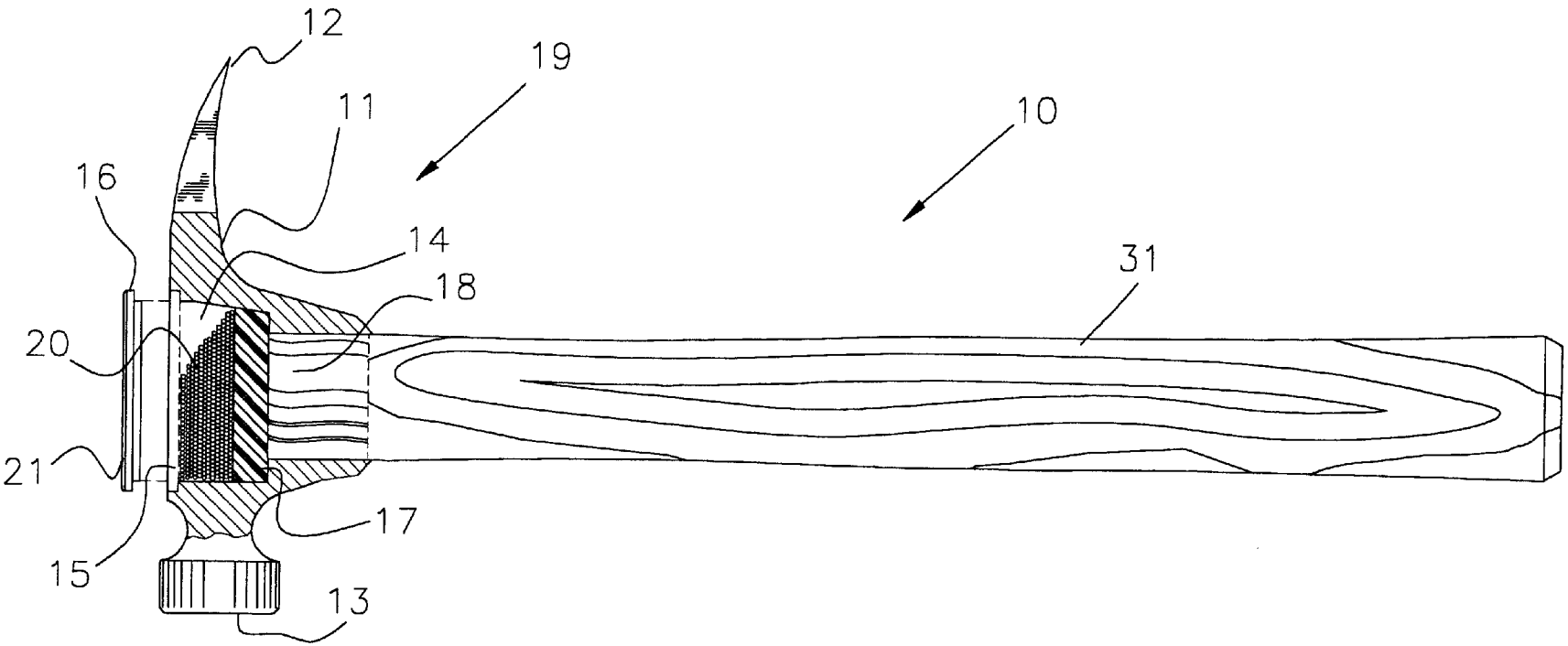
FIG. 1 is a side elevation partially in section and exploded view of a hammer.
Figure 3:
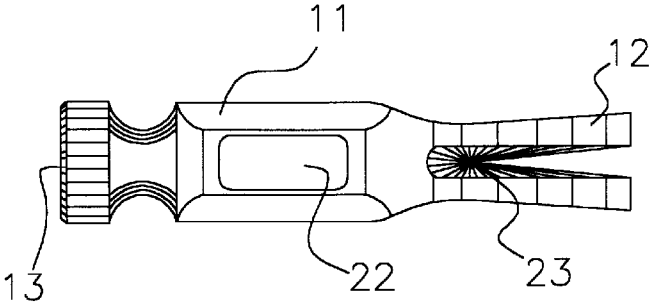
FIG. 3 is a bottom view of a hammer head.
Figure 5:
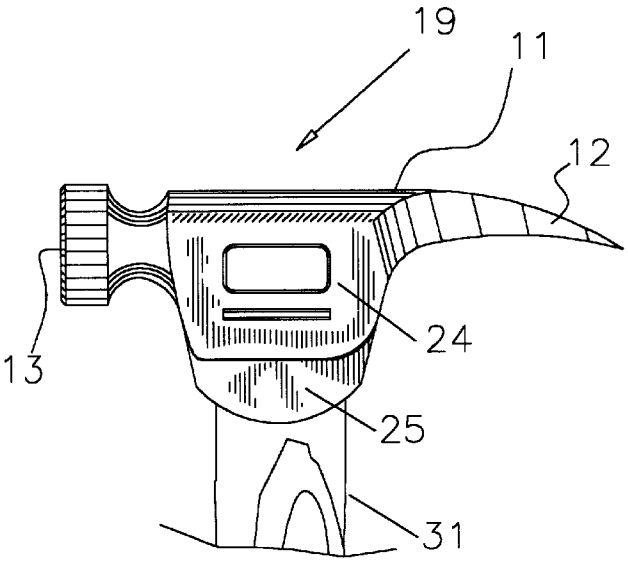
FIG. 5 is an illustrative side view of a hammer head.
Figure 2:
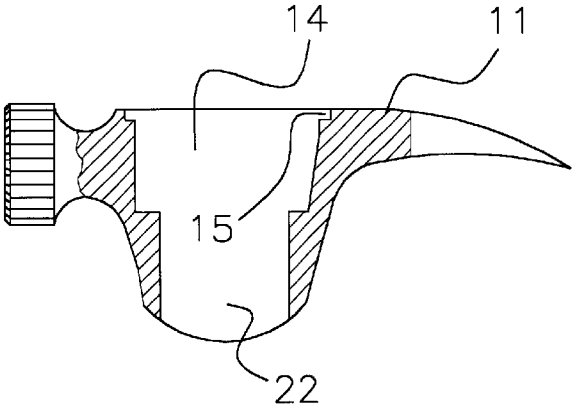
FIG. 2 is a side elevation partially in section of a hammer head.
Figure 4:
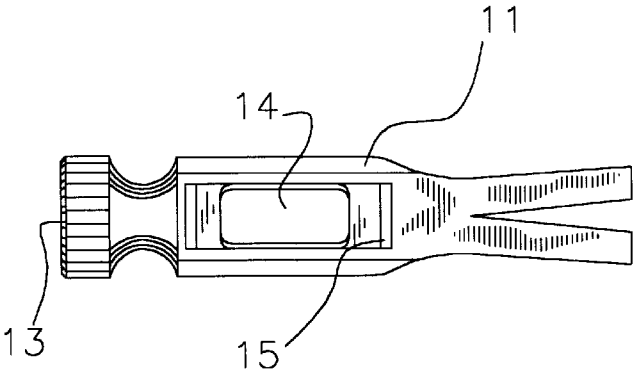
FIG. 4 is a top plan view of a hammer head.

Referring now to the drawings wherein like numerals designate like and corresponding parts throughout the several views. In FIG. 1 the invention is designated overall by the numeral 10 and the head assembly is designated overall by the numeral 19 and the head casting alone is designated by the numeral 11.

Referring now to FIG. 1, the shock absorbing claw hammer head assembly 19 which has a striking face portion 13, a claw portion 12 extending generally opposite the face portion 13 and includes a natural, hickory wooden handle 31 extending generally perpendicular to the head casting 11. Other materials such as, for example, Fiberglas or steel may be used for the handle 31.

The head 11 may be cast, forged or machined, and includes a chamber 14 extending completely through the head casting 11 at an angle perpendicular to the axis of both the claw portion 12 and the face portion 13. The chamber 14 is shown rectangular in shape, although other shapes are acceptable, and stepped down from a larger recess, inset step 15, to a smaller recess handle aperture 22 into which the tang end 18 of handle 31 is inserted with a force fit.

Epoxy 17 adheres handle 31 in place. Epoxy 17 forms the floor of chamber 14 as well as securing the handle 31 in the chamber 14.

The larger chamber 14 has inset steps 15 forming stops onto which a cover plate 16 can be slidably fitted and secured. The remainder of the chamber 14 is open to receive shot weight 20. The shot weight 20 may be a 0.050 Diameter steel shot which is thereafter sealed inside the chamber 14 by the cover plate 16 being fitted and welded in place. The shot weight may be steel, or lead/tungsten or other heavy material.

After assembly of cover plate 16 in the inset step 15, the entire head assembly is cleaned and finished (brushed) to produce a smooth appearance.

Figure 6:
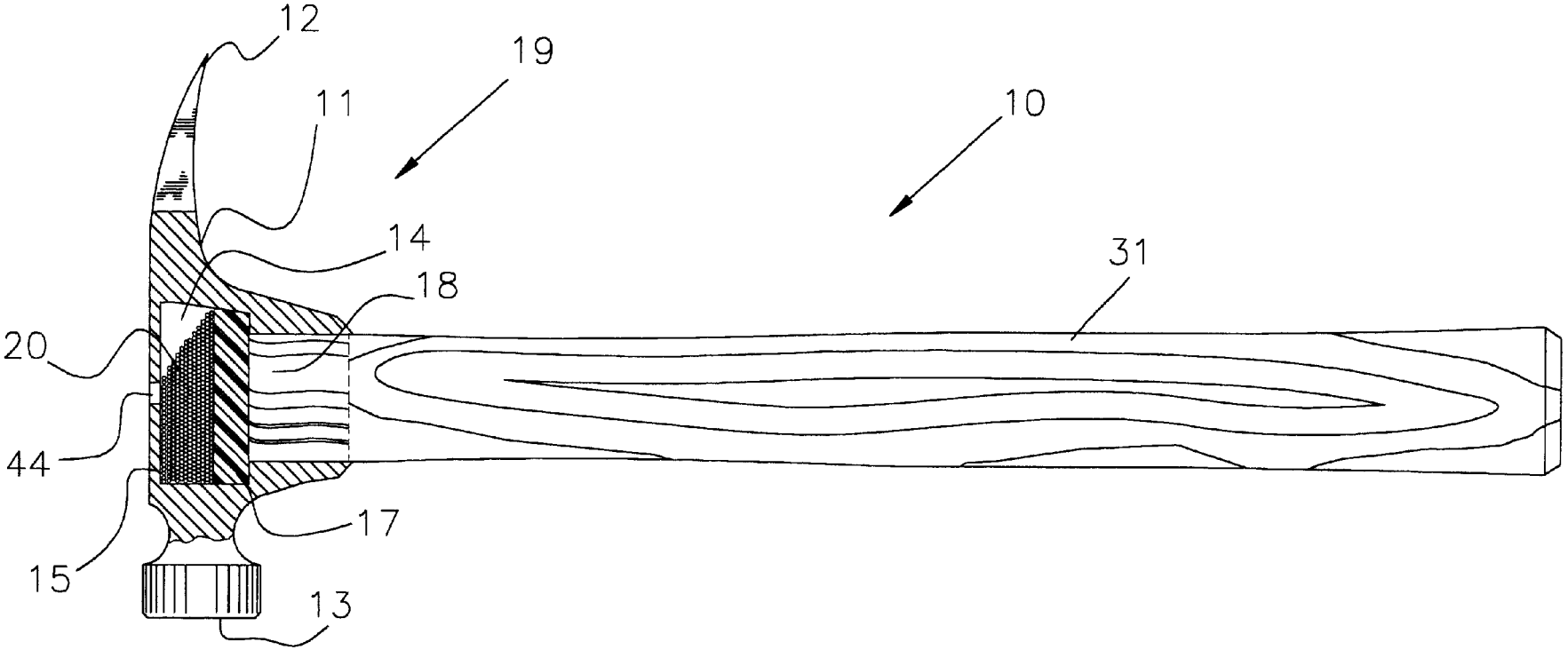
FIG. 6 is a side view, partially in section, of a second embodiment of the invention.

Referring now to FIG. 6, the head 11 is cast without the separate lid, cover plate 16. The lid (plate 16) is cast integral to the head 11 with a small hole 44 in the center whereupon the epoxy 17 is injected to secure the handle 31. Head assembly 19 is fitted with handle 31 at its tang end 18. Epoxy 17 adheres handle 31 in place. Epoxy 17 also forms the floor of chamber 14. Metal shot 20 partially fills chamber 14. Access hole 44 permits epoxy 17 to be poured into chamber 14. Hole 44 can be subsequently sealed by welding. The weld will then be blended to match the existing head 11. The hole 44 may be ¼" and will not require specialty welding. The hole 44 may be taperd from ¼" to 3⁄16" inwards.

Striking face 13, shot filled chamber 14 and claws 12 are on a common axis perpendicular to handle 11.

In summary, the dead blow hammer 10 is a precision, framing instrument designed with a computerized CAD/CAM system and field tested by industry. The hammer 10 provides significantly more driving power than conventional hammers and absorbs a significant amount of the hammer shock and vibration before they reach the user's forearm and elbow, greatly reducing fatigue and stress. The hammer 10 is designed to deliver sustained impact and maximum striking force with almost no rebound and for a significant reduction of shock. The reduction of shock is significant and readily noticeable.

The complete Dead Blow line of hammers is available in various sizes to suit every job and user. The 16 oz. hammer is available in a smooth face only. The 20 oz. and 24 oz. are available with both checker and smooth face.

Several components make the Dead Blow absorb shock, a combination of the active shots 20 within the hammer head 11 and the high grade American hickory. The head to handle assembly process make the hammer both comfortable and durable and the head-to-handle assembly process adds to the solid feel of the tool.

Carpal Tunnel Syndrome (CTS) and "Tenosynovitis are conditions caused by the inherent shock and design of the older common standard hammer. These conditions are significantly eliminated by the dead blow hammer of the invention. The active shots neutralize the impact of every hammer blow. The sculpted handle additionally absorbs any other transfer recoil before it reaches the user's hand. "Carpenter's Elbow" (Epicondylitis) will be a thing of the past.

The above description of exemplary embodiments of the invention are made by way of example and not for purposes of limitation. Many variations may be made to the embodiments and methods disclosed herein without departing from the scope and spirit of the invention.

What is claimed is:

1. A shock absorbing claw hammer comprising:

a hammer head having a striking face surface, a claw portion extending generally opposite said striking face portion, a chamber extending completely through said hammer head at an angle perpendicular to said face portion and said claw portion, said chamber having an inset step at a first end and an aperture at a second end, a handle being inserted with a force fit into said aperture at said second end, said handle being coupled and affixed to said hammer head chamber aperture by an epoxy base, said epoxy base forming a floor of said rectangular chamber, a plurality of metal shot being inserted in said head casting chamber and incompletely filling said chamber, and a cover plate being inserted within said hammer head first end inset step and being affixed thereto by welding.

2. A shock absorbing claw hammer as claimed in claim 1 wherein said steel shot has mixed sizes and said handle is hickory wood.

3. A shock absorbing hammer comprising:

a head having a striking face portion, a claw portion, extending generally opposite said face portion, a chamber formed in said head, said chamber having an access hole in a first end and a handle aperture in a second end, said chamber extending through said head at an angle perpendicular to said face portion and said claw portion, a handle being inserted with a force fit into said handle aperture, said handle being coupled and affixed to said handle aperture by an epoxy base, said epoxy forming a floor of said chamber, a plurality of metal shot being inserted through said access hole in said chamber and incompletely filling said chamber, and a cover plate being inserted within said access hole and being affixed thereto by welding thereby sealing said access hole.

* * * * *